US005214805A

United States Patent [19]

Cochran

[11] Patent Number: 5,214,805

[45] Date of Patent: Jun. 1, 1993

[54] BLOUSING DEVICE

[75] Inventor: Donald G. Cochran, 9812 Luders Ave., Garden Grove, Calif. 92644

[73] Assignee: Donald G. Cochran, Garden Grove, Calif.

[21] Appl. No.: 966,869

[22] Filed: Oct. 26, 1992

[51] Int. Cl.[5] ..... A41F 17/04

[52] U.S. Cl. ..... 2/232; 2/311; 2/312; 2/338

[58] Field of Search ..... 2/232, 232 A, 311, 312, 2/309, 317, 318, 320, 336, 337, 338

[56] References Cited

U.S. PATENT DOCUMENTS

| | | | |
|---|---|---|---|
| 2,720,656 | 10/1955 | Allan, Jr. | 2/232 |
| 2,869,138 | 1/1959 | Hankoff | 2/232 |
| 2,962,724 | 12/1960 | Wilkens | 2/232 |
| 2,983,926 | 5/1961 | Turner | 2/232 |
| 4,825,475 | 5/1989 | Smart . | |

OTHER PUBLICATIONS

"Baseball Stirrups", East Tenn. company, Johnson Citym, Tenn.

Photocopy of elastic braided leg strap with hooks on each end thereof.

*Primary Examiner*—Clifford D. Crowder

*Assistant Examiner*—Gloria Hale

[57] ABSTRACT

An apparatus is provided for blousing a pant leg. The central hole of a tubular, torus shaped, horizontally positioned, elastic sleeve is of a size to accept a calf of a person's leg. The sleeve includes a pair of opposing slits that each provide entry into the interior of the sleeve from above. A pair of foundation forms each have a curved, horizontally extending first portion positioned within the sleeve for providing conformal alignment of the sleeve with the natural curvature of a human calf. Each form further includes a second portion contiguous with the first portion and extending vertically from the first portion for protruding through one of the slits of the sleeve. A strap attachment slit is further included on each second portion for engaging at least one elastic anchoring strap, the strap holding the sleeve in place on the calf at a position adjacent to, and above, the top of a boot. As such, the sleeve encircles the calf, and the pant leg is bloused around the outside of the sleeve and folded under and upward between the sleeve and the calf, whereby the pant leg is elastically held between the sleeve and the calf.

8 Claims, 2 Drawing Sheets

BLOUSING DEVICE

FIELD OF THE INVENTION

This invention relates generally to apparel, and, more particularly, is directed towards a device for blousing a pant leg.

BACKGROUND OF THE INVENTION

People who frequently wear uniforms, such as military personnel, police officers, and the like, know that their appearance is extremely important and subject to constant inspection. Almost every uniform includes a pair of pants. Pants, however, have a tendency to cling to one side of the leg, to bunch up around the wearer's socks, and to seek their flat, pressed shape. As such, it has been difficult for many pant wearers to achieve and maintain a full, bloused look with their pant legs. Such a full, bloused appearance creates a more distinguished, proper, uniform appearance overall, and is consequently sought by many uniform wearers.

Several devices exist for blousing pant legs, several of which are supplied by the military. For example, one such device is simply an elastic braided rope having small interconnecting hooks on each end. The rope is typically of a color suitable for military uniforms, and is strapped around the leg and the pant leg. The pant leg is then pulled up and folded over the strap to hang in a bloused fashion. The most significant drawback to devices of this type is that the strap moves up the leg when a person walks, runs, reaches for objects in a high location, and the like. As such, the deice and the pant leg must frequently be pulled down into a proper position.

Another device, taught in U.S. Pat. No. 4,825,475, issued on May 2, 1989, illustrates a strap with hooks for engaging the hem of a pant leg and a hook-and-loop type fastener on each of its end. Such a device has many of the same drawbacks of the aforementioned rope device in that it has a tendency to ride up on a person's leg as he or she walks, runs, stretches, or the like. Another similar device is a metal band sewn into or attached to the hem of the pants. Such a device keeps the pant leg in a circular, bloused shape, yet is difficult to use in that it must be removed before being washed, and adds significant weight to the pants. Further, such a device is also prone to riding up on a person's leg during stretching or the like.

Stirrups of the type worn with baseball uniforms are less likely to ride-up on a person's leg during exercising. Pant legs are typically tucked-up under an elastic band of such stirrups. However, pant legs tend to become untucked from such elastic stirrups easily, necessitating frequent monitoring by the wearer. Further, such stirrups are visible while worn, which is not always appropriate.

Clearly, then, there is a need for a pant blousing device that is more effectively blouses a pant leg. Such a needed device would be inexpensive to manufacture, would not be visible when worn, would be completely adjustable, and would be extremely easy to use. Such a needed device would not require constant monitoring by the wearer. The present invention fulfills these needs and provides further related advantages.

SUMMARY OF THE INVENTION

The present invention is a blousing device for a pant leg. The central hole of a tubular, torus shaped, horizontally positioned, elastic sleeve is of a size of accept a calf of a person's leg. The sleeve includes a pair of opposing slits that each provide entry into the interior of the sleeve from above. A pair of foundation forms each have a curved, horizontally extending first portion positioned within the sleeve for providing conformal alignment of the sleeve with the natural curvature of a human calf. Each form further includes a second portion contiguous with the first portion and extending vertically from the first portion for protruding through one of the slits of the sleeve. A strap attachment means is further included on each second portion. At least one elastic anchoring strap means is connected to at least one of the strap attachment means for holding the sleeve in place on the calf at a position adjacent to, and above, the top of a boot. As such, the sleeve encircles the calf, and the pant leg is bloused around the outside of the sleeve and folded under and upward between the sleeve and the calf, whereby the pant leg is elastically held between the sleeve and the calf.

The present invention effectively blouses a pant leg. The present device is inexpensive to manufacture, is not visible when worn, is adjustable to different sizes of wearers and footwear, and is extremely easy to use. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
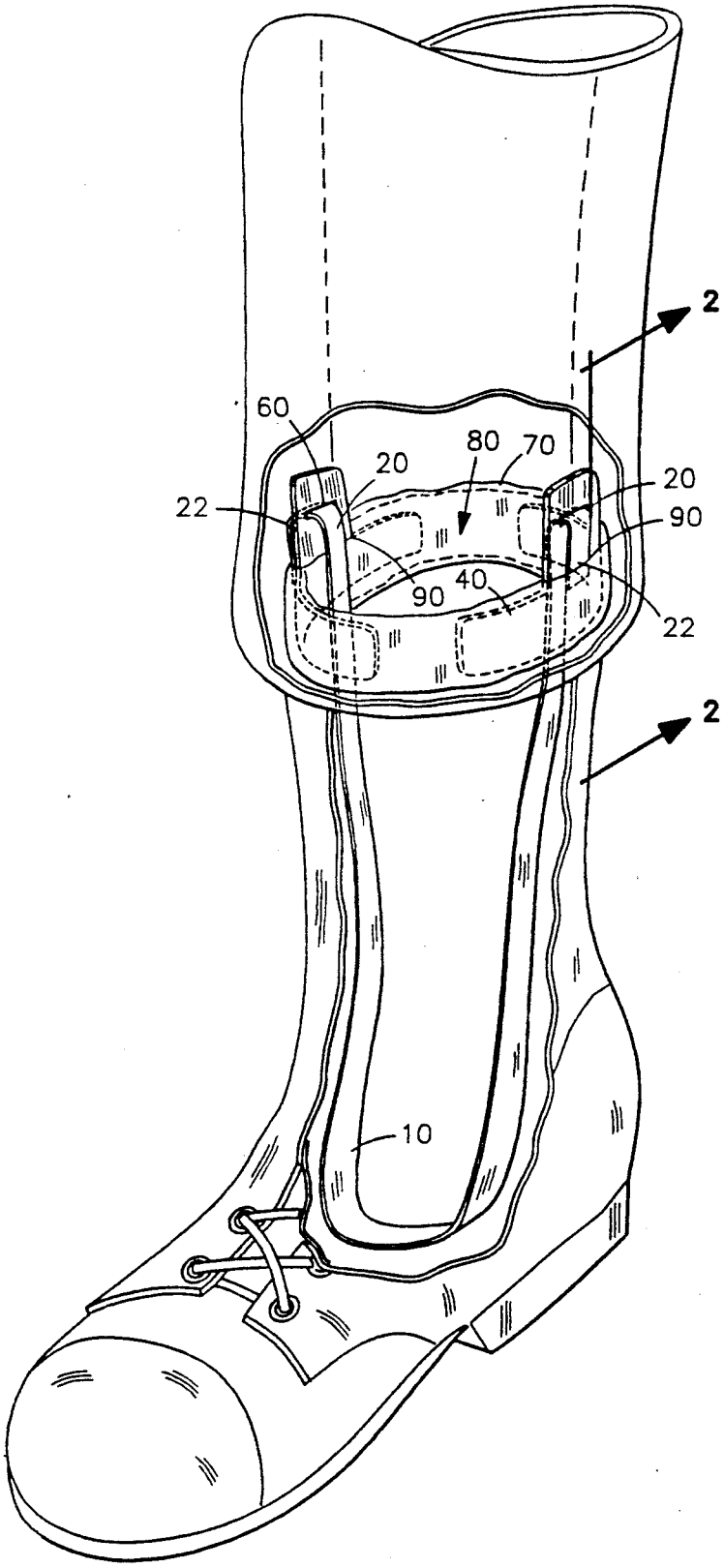
FIG. 1 is a perspective illustration of the invention, illustrating a pant leg and boot partially cut away to reveal a sleeve of the invention, a pair of foundation forms of the invention shown in phantom outline, and an attachment strap.
Figure 2:
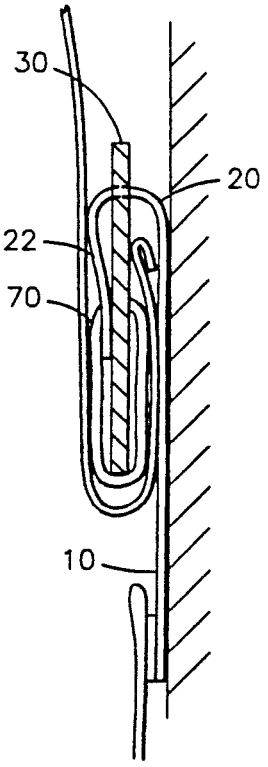
FIG. 2 is a cross sectional view, taken generally along lines 2—2 of FIG. 1, illustrating a pant leg folded up under the sleeve of the invention.

FIGS. 1 and 2 show a blousing device 5 for a pant leg. The central hole 80 of a tubular, torus shaped, horizontally positioned, elastic sleeve 70 is of a size to accept the lower portion of a person's calf. The sleeve 70 includes a pair of opposing slits 90 that each provide entry into the interior of the sleeve 70 from above. The sleeve 70 is preferably manufactured from a flexible fabric material, or the like. An elastic loop band may be further included within the sleeve 70 for providing improved elasticity of the sleeve 70 (not shown) and allowing the sleeve 70 to expand around the person's calf.

A pair of foundation forms 30 are made of a stiff, flexibly resilient sheet material, such as plastic sheet material. Each form 30 has a curved, horizontally extending first portion 32 positioned within the sleeve 70 for providing conformal alignment of the sleeve 70 with the natural curvature of a human calf. Each form 30 further includes a second portion 34 contiguous with the first portion 32 and extending vertically from the first portion 32 for protruding through one of the slits 90 of the sleeve 70. A strap attachment means, such as a thin slot 60, is further included on each second portion 34. Alternative strap attachment means may readily be used by one skilled in the art, such as a pair of parallel slots 60 (not shown), a snap attachment means (not shown), or a hook-and-loop type attachment means (not shown).

At least one elastic anchoring strap means 20, such as an elastic foot strap 10, is connected to at least one of the slots 60 for holding the sleeve 70 in place on the calf at a position adjacent to, and above, the top of a boot. As such, the sleeve 70 encircles the lower portion of the calf, and the pant leg is bloused around the outside of the sleeve 70 and folded under and upward between the sleeve 70 and the calf, whereby the pant leg is elastically held between the sleeve 70 and the calf (FIG. 2). Optionally, the sleeve 70 may be broken such that it has two ends, each end having mutual engagement and disengagement means 50 as desired. As such, the sleeve 70 ends may be disengaged for placing the sleeve 70 around the calf and thereafter the ends may be engaged for providing the torus shape. Such mutual engagement and disengagement means 50 may include, for example, snaps, buttons, hook-and-loop type fasteners, clips, and the like.

Figure 4:
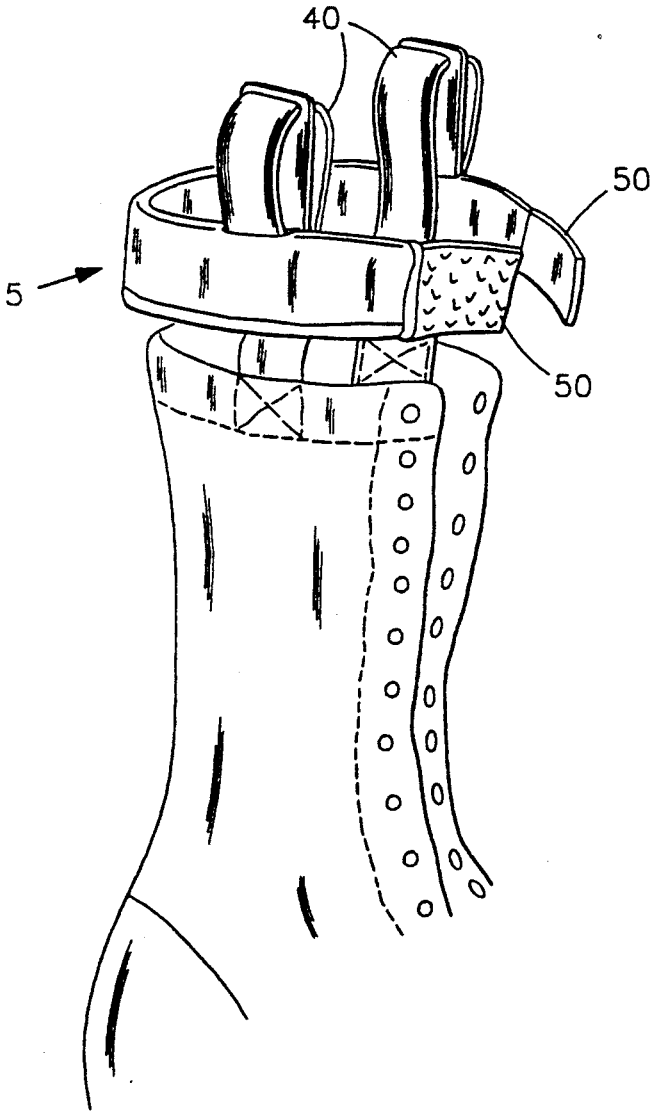
FIG. 4 is a partial perspective illustration of one embodiment of the invention, illustrating one end of each of a pair of attachment straps attached to a boot.

In one embodiment of the invention, the foot strap 10 is positioned around the bottom of a foot and has two free ends 22. The free ends 22 each extend upwardly along opposite sides of the calf to engage one of the slots 60 for holding the device 5 in position to accommodate motion of the foot and the pant leg in walking and stooping. As such, the device 5 is pulled by the pant leg with the foot strap 10 stretching and contracting to allow the sleeve 70 to move up and down the leg. In an alternate embodiment of the invention, illustrated in FIG. 4, the anchoring strap means 20 is a pair of straps 40, each strap 40 having one end fixed to one side of a boot, and other end being free for fixing to one of the slots 60. Each slot 60 is an elongate, relatively thin slot for accepting and retaining one of the ends 22 of the anchoring strap means 20, the strap means 20 being fed through the slot so that the anchoring strap 20 is fixed to the second portion 34 of the foundation form 30.

Figure 3:
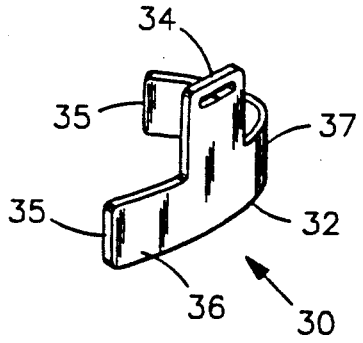
FIG. 3 is a perspective illustration of a foundation form of FIG. 1.

Preferably, the first portion 32 of the foundation form 30 defines two opposing ends 35. The second portion 34 of the foundation form 30 is fixed to the first portion 32 at a position closer to one of the ends then to the other of the ends, forming two unequal legs 36,37 extending normally away from the second portion 34 (FIG. 3). As such, the longer leg 37 may be inserted into one of the slits 90 of the sleeve 70 prior to inserting the short leg 36, thereby permitting the slit 90 to have a shortened length and permitting the first portion 32 to have an extended length with respect to the length of the slit 90. Preferably, the first portions 32 of the foundation forms 30 are of such length as to extend within the sleeve 70 to mutually overlapping positions.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A blousing device for a pant leg comprising:

a tubular, torus shaped, horizontally positioned, elastic sleeve, the central hole of the torus being of a size to accept a calf of a person's leg therein, the sleeve having a pair of opposing slits, each one of the slits for providing entry into the interior of the sleeve from above;

a pair of foundation forms made of a stiff, flexibly resilient sheet material, each said one of the forms having a curved, horizontally extending first portion positioned within the sleeve for providing conformal alignment of the sleeve with the calf, and a second portion contiguous with the first portion, and extending vertically from the first portion for protruding through one of the slits, the second portion having a strap attachment means thereon; and at least one elastic anchoring strap means connected to at least one of the strap attachment means for holding the sleeve in place on the calf at a position adjacent to, and above the top of a boot, such that the sleeve encircles the calf, the pant leg bloused around the outside of the sleeve and folded under and upward between the sleeve and the calf, the pant leg being elastically held between the sleeve and the calf.

2. The blousing device of claim 1 further including an elastic loop band within the sleeve for providing improved elasticity of the sleeve.

3. The blousing device of claim 1 wherein the anchoring strap means is an elastic foot strap positioned around the bottom of a foot, and having two free ends, the free ends further extending upwardly along opposite sides of the calf to engage the attachment means for holding the device in position to accommodate motion of the foot and the pant leg in walking and stooping whereby the device is pulled by the pant leg, the foot strap stretching and contracting to allow the sleeve to move up and down the leg.

4. The blousing device of claim 3 wherein the attachment means is an elongate slot for accepting one of the ends of the anchoring strap, the strap being fed through the slot so that the anchoring strap is fixed to the second portion of the foundation form.

5. The blousing device of claim 3 wherein the first portion of the foundation form defines two opposing ends, the second portion of the foundation form being fixed to the first portion at a position closer to one of the ends then to the other of the ends forming two unequal legs extending normally away from the second portion, so that the longer of the two legs may be inserted into one of the slits of the sleeve prior to inserting the shorter of the two legs, thereby permitting the slit to have a shortened length, and permitting the first portion to have an extended length with respect to the length of the slit.

6. The blousing device of claim 1 wherein the first portions of the pair of foundation forms are of such length as to extend within the sleeve to mutually overlapped positions.

7. The blousing device of claim 1 wherein the anchoring strap means comprises a pair of straps, each said strap having one end fixed to one side of a boot, the other end being free for fixing to the attachment means.

8. The blousing device of claim 1 wherein the sleeve has two ends, the ends having means for mutual engagement and disengagement as desired, so that the sleeve ends may be disengaged for placing the sleeve around the calf and thereafter engaged for providing the torus shape.

* * * * *